US010717092B2

(12) United States Patent
Songbe

(10) Patent No.: US 10,717,092 B2
(45) Date of Patent: Jul. 21, 2020

(54) SPRAY NOZZLE, IN PARTICULAR FOR A SYSTEM FOR DISPENSING A PRESSURIZED FLUID PROVIDED WITH A PUSHBUTTON, AND DISPENSING SYSTEM COMPRISING SUCH A NOZZLE

(71) Applicant: ALBEA LE TREPORT, Le Treport (FR)

(72) Inventor: Jean-Pierre Songbe, Eu (FR)

(73) Assignee: ALBEA LE TREPORT, Le Treport (FR)

( * ) Notice: Subject to any disclaimer, the term of this patent is extended or adjusted under 35 U.S.C. 154(b) by 0 days.

(21) Appl. No.: 15/487,387

(22) Filed: Apr. 13, 2017

(65) Prior Publication Data

US 2017/0297042 A1 Oct. 19, 2017

(30) Foreign Application Priority Data

Apr. 14, 2016 (FR) ..... 16 53320

(51) Int. Cl.

| | |
|---|---|
| ***B05B 1/34*** | (2006.01) |
| ***B05B 11/00*** | (2006.01) |
| ***B65D 83/28*** | (2006.01) |
| *B65D 83/20* | (2006.01) |

(52) U.S. Cl.

CPC ..... *B05B 1/3405* (2013.01); *B05B 1/3436* (2013.01); *B05B 1/3494* (2013.01); *B05B 11/30* (2013.01); *B05B 11/3052* (2013.01); *B65D 83/28* (2013.01); *B05B 1/3442* (2013.01); *B65D 83/20* (2013.01)

(58) Field of Classification Search

CPC ... B05B 1/3442; B05B 1/3405; B05B 1/3436; B05B 1/3494; B05B 11/30; B05B 11/3052; B65D 83/28; B65D 83/20; F02M 61/162–163; B23B 7/7636

USPC ..... 239/463, 466, 490, 491, 498, 500; 251/359

See application file for complete search history.

(56) References Cited

U.S. PATENT DOCUMENTS 3,129,893 A * 4/1964 Green ..... B65D 83/44 239/490
4,161,288 A * 7/1979 McKinney ..... B05B 1/12 239/333
4,260,110 A * 4/1981 Werding ..... B05B 1/3436 239/404
4,979,678 A * 12/1990 Ruscitti ..... B05B 1/3405 239/466

(Continued)

FOREIGN PATENT DOCUMENTS

WO WO2003/061839 7/2003

*Primary Examiner* — Alex M Valvis
*Assistant Examiner* — Joseph A Greenlund
(74) *Attorney, Agent, or Firm* — Steven M. Greenberg, Esq.; Shutts & Bowen LLP

(57) ABSTRACT

A spray nozzle for a system for dispensing a pressurized product is provided with a pushbutton. The nozzle includes a dispensing orifice and a vortex chamber emerging on the dispensing orifice. The chamber includes a conical part defined by a conical side surface. The conical side surface converges from an upstream end toward a downstream supply end of the dispensing orifice. The nozzle further includes at least one supply channel of the vortex chamber, each supply channel emerging in the upstream end of the conical part, the conical side surface having at least one stepped portion provided with multiple levels.

13 Claims, 4 Drawing Sheets

(56) References Cited

U.S. PATENT DOCUMENTS 4,989,790 A * 2/1991 Martin ..... B05B 1/3447 239/483
5,207,384 A * 5/1993 Horsting ..... F02M 51/06 239/114
5,711,488 A * 1/1998 Lund ..... B05B 1/3436 239/333
6,371,389 B1 * 4/2002 Bickart ..... B05B 1/3436 239/491
6,814,307 B2 * 11/2004 Hurley ..... B05B 1/3484 239/463
7,300,001 B2 * 11/2007 Kuo ..... A61M 11/00 239/333
7,438,241 B2 * 10/2008 Goenka ..... F02M 61/1853 239/500
7,614,780 B2 * 11/2009 Corti ..... B29B 7/7668 366/162.5
7,748,648 B2 * 7/2010 Songbe ..... B05B 1/3436 239/468
7,938,342 B2 * 5/2011 Octeau ..... B05B 1/3436 239/333
8,413,912 B2 * 4/2013 Songbe ..... B05B 1/3436 239/337
8,418,940 B2 * 4/2013 Songbe ..... B05B 1/3436 239/468
8,807,457 B2 * 8/2014 Songbe ..... B05B 1/3436 239/463
9,174,229 B2 * 11/2015 Smith ..... B05B 1/3442
9,381,525 B2 * 7/2016 Shin ..... B05B 1/02
9,604,773 B2 * 3/2017 Verville ..... B65D 83/205
2001/0011687 A1 * 8/2001 Benoist ..... B05B 1/3436 239/492
2008/0179428 A1 * 7/2008 Songbe ..... B05B 1/02 239/491
2011/0303767 A1 * 12/2011 Smith ..... B05B 1/3442 239/338
2012/0217322 A1 8/2012 Songbe
2013/0277443 A1 * 10/2013 Croll ..... A61M 11/06 239/1
2017/0065990 A1 * 3/2017 Gopalan ..... B05B 1/3436
2017/0297042 A1 * 10/2017 Songbe ..... B05B 1/3405

* cited by examiner

SPRAY NOZZLE, IN PARTICULAR FOR A SYSTEM FOR DISPENSING A PRESSURIZED FLUID PROVIDED WITH A PUSHBUTTON, AND DISPENSING SYSTEM COMPRISING SUCH A NOZZLE

CROSS REFERENCE TO RELATED APPLICATIONS

This application claims priority under 35 U.S.C. § 119(a) to French Patent Application Serial Number 1653320, filed Apr. 14, 2016, the entire teachings of which are incorporated herein by reference.

BACKGROUND OF THE INVENTION

Field of the Invention

The invention relates to a spray nozzle for a receptacle, in particular for a system for dispensing a pressurized fluid provided with a pushbutton. The invention also relates to a dispensing system comprising such a nozzle.

Description of the Related Art

In one particular application, the dispensing system is intended to equip bottles used in perfumery, cosmetics or pharmaceutical treatments. Indeed, this type of bottle contains a product that is retrieved by the dispensing system comprising a device for the pressurized withdrawal of said product, said system being actuated for example by a pushbutton to allow the spraying of said product. In general, the withdrawal device comprises a manually actuated pump or valve, for example actuated via the pushbutton.

Such pushbuttons are traditionally made in at least two parts, including an actuating body and a spray nozzle that are assembled to one another. The nozzle generally comprises a vortex chamber provided with a dispensing orifice, as well as at least one supply channel of said chamber.

The withdrawal device withdraws the product from the bottle via a tube, and pushes it under pressure to the inside of a conduit arranged in the pushbutton, which is the actuating element of the withdrawal device. This conduit emerges in a so-called vortex chamber intended to rotate the liquid very quickly and therefore give it speed and the effects of the centrifugal force. This vortex chamber is extended at its center by an outlet orifice through which the product escapes to the outside with a high speed. Moved by this speed, and subject to the centrifugal forces, the liquid fractures into droplets and forms an aerosol. The size of the droplets coming from the vortex chamber depends in part on the force and speed with which the user actuates the pump by pressing on the pushbutton with his finger, since the induced pressure depends thereon.

In order to ensure good uniformity of the size of said droplets, one technology consists of using a conical vortex chamber. Thus, the stream rotates in a chamber in the form of a pool that impacts itself after it leaves through the dispensing orifice.

French Patent FR 2,952,360 shows one example of such a conical vortex chamber. Here, the supply channels emerge tangentially in the vortex chamber, which is cylindrical of revolution to rotate the product very quickly. Furthermore, the dispensing orifice has a smaller diameter relative to that of said chamber so that the rotating product escapes through said orifice, impacting itself with a sufficient speed to split into droplets forming the aerosol.

However, this technology has a limited efficacy for fluids whose viscosity is close to that of water. When the products to be sprayed have higher viscosities, for example up to 50 or 100 times that of water, the impaction is low and the retrieval is done in the form of a hollow cone spray or a jet. One thus does not obtain droplets with the desired size.

BRIEF SUMMARY OF THE INVENTION

The present disclosure aims to resolve the foregoing problem and seeks to provide a spray nozzle for a dispensing system capable of spraying products whose viscosity is higher than that of water, so as to obtain droplets according to the desired size for perfumery, cosmetics or pharmaceutical treatment bottles.

To that end, one embodiment of the invention relates to a spray nozzle, in particular for a system for dispensing a pressurized product provided with a pushbutton, the nozzle comprising a dispensing orifice and a vortex chamber emerging on the dispensing orifice, the chamber including a conical part defined by a conical side surface, said conical side surface converging from an upstream end toward a downstream supply end of the dispensing orifice, the nozzle further comprising at least one supply channel of said vortex chamber, the supply channel(s) emerging in the upstream end of the conical part, the conical side surface having at least one stepped portion provided with one level or multiple levels.

The stepped portions favor greater impaction of the pool on itself, and thus the formation of fine enough droplets. Indeed, when the fluid rotates in the form of a laminar pool on the surface of the conical part and approaches the outlet orifice, the pool jumps from one stage to the other between two levels, which causes the turbulence of the flow. One thus manages to create significant turbulence despite the viscosity of the product.

According to different embodiments of the invention, which may be considered together or separately:

- the stepped portion(s) extend from the upstream end to the downstream end of the conical side surface,
- the stepped portion(s) extend over a reduced part of the conical side surface,
- the conical side surface has a conical geometry of revolution around a dispensing axis,
- the levels are orthogonal to the dispensing axis,
- the stepped portion(s) have a stair-stepping shape, the levels of which forms stairs,
- the stepped portion(s) have a width that decreases in proportion to the diameter of the conical part between the upstream end and the downstream end,
- the side surface comprises at least one continuous portion, i.e., without levels,
- the stepped portions are separated by a continuous portion,
- the stepped portions are situated between a base and an apex of the conical part and at a distance from the base and the apex,
- the continuous portion(s) overhang the adjacent stepped portion(s),
- the conical side surface comprises several stepped portions positioned on the side surface,
- the stepped portions are arranged symmetrically,
- the stepped portions are arranged periodically on the conical side surface,
- the conical side surface comprises four stepped portions, two stepped portions being opposite one another, the supply channels extend in a plane transverse to the conical side surface, the chamber comprises a cylindrical part arranged at the upstream end of the conical part, the cylindrical part is defined by a cylindrical side surface, the cylindrical part has a diameter at least equal to the diameter of the upstream end, the downstream end of the supply channel(s) emerges tangentially in the cylindrical part of the chamber, the supply channel(s) are defined between an outer wall and an inner wall, the outer wall is tangent to the cylindrical side surface of the cylindrical part, the outer and inner walls are orthogonal to the upstream end, the inner wall converges toward the outer wall going toward the downstream end of the channel, the inner wall forms an angle of 10° with the outer wall, the inner wall is connected to the cylindrical surface of the chamber by a rounded corner, the rounded corner has a radius smaller than 0.1 mm, said dispensing orifice has a cylindrical geometry whose inner dimension is equal to the inner dimension of the downstream end, the axial dimension of the vortex chamber is at least equal to 80% of the inner dimension of the upstream end, the axial dimension of the vortex chamber comprised between 90% and 200% of the inner dimension of the upstream end, the axial dimension of the conical part is at least 50% of the axial dimension of the vortex chamber, preferably 70%, or even 80%, the inner dimension of the downstream end is less than 50% of the inner dimension of the upstream end, the inner dimension of the downstream end is comprised between 20% and 40% of the inner dimension of the upstream end, the inner dimension of the downstream end is less than or equal to 0.24 mm, the axial dimension of the dispensing orifice is less than 50% of the inner dimension of said orifice, the downstream end of the supply channel or the set of downstream ends of each of the supply channels forms a supply section of the vortex chamber, the surface of said section being less than 10% of the inner surface of the upstream end, the surface of the supply section of the vortex chamber is comprised between 0.01 $mm^2$ and 0.03 $mm^2$, the nozzle has at least two supply channels for the vortex chamber, said channels being positioned symmetrically relative to the dispensing axis, the nozzle has a proximal wall in which a cavity is formed of the vortex chamber and the supply channel(s).

The present invention also relates to a nozzle-anvil assembly as previously described.

The invention also relates to a system for dispensing a pressurized product for a receptacle, in particular a cosmetic product bottle, the system comprising such a spray nozzle. The dispenser preferably comprises a pushbutton arranged to support the spray nozzle.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Figure 1:
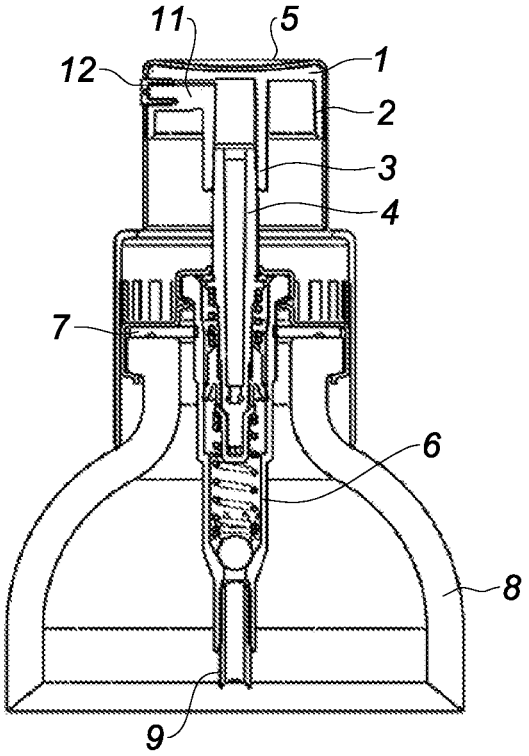
FIG. 1 schematically shows a sectional view of the top of a container provided with a dispensing means according to a first embodiment of the invention.

FIG. 1 shows a cosmetic product bottle comprising a system for dispensing a pressurized product according to a first embodiment. The dispensing system is provided with a pushbutton. The pushbutton comprises a body 1 having an annular skirt 2 that surrounds a well 3 for mounting the pushbutton on an intake tube 4 for the pressurized product. Furthermore, the pushbutton comprises an upper zone 5 allowing the user to exert pressure on said pushbutton using a finger so as to be able to move said pushbutton axially.

The dispensing system comprises a withdrawal device 6 equipped with an intake tube 4 for the pressurized product that is inserted tightly into the well 3. In a known manner, the dispensing system further comprises mounting means 7 for mounting on a bottle 8 containing the product and withdrawal means 9 for withdrawing the product from inside said bottle that are arranged to supply the intake tube 4 with pressurized product. The withdrawal device 6 here comprises a manually actuated pump, or in the case where the product is packaged pressurized in the bottle 8, a manually actuated valve. Thus, upon a manual movement of the pushbutton, the pump or the valve is actuated to supply the intake tube 4 with pressurized product. The mounting means 7 for example comprise a fastening ring and a decorative collar to hide the ring and the intake tube 4.

Figure 2:
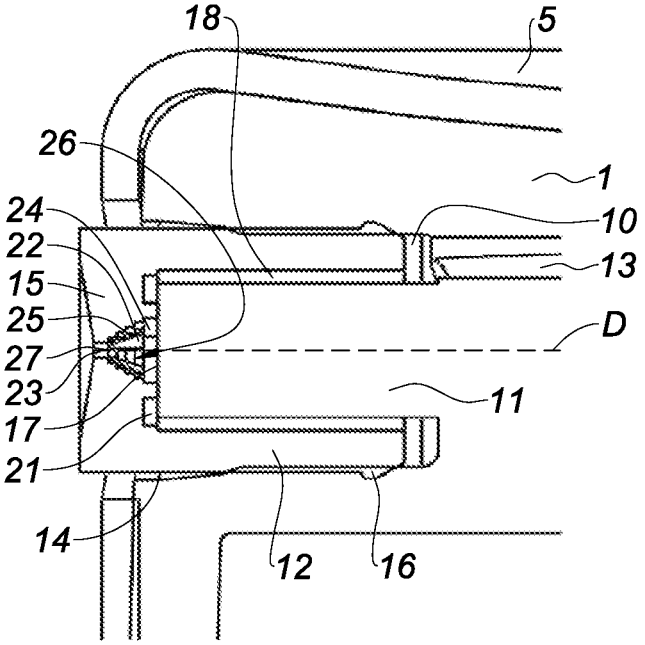
FIG. 2 schematically shows an enlarged sectional view of a pushbutton of the dispensing system of FIG. 1.

As shown in FIG. 2, the body 1 also has an annular housing 10 that is in communication with the well 3. In the illustrated embodiment, the housing 10 has an axis perpendicular to that of the mounting well 3 to allow the product to be screwed sideways relative to the body 1 of the pushbutton. In an alternative that is not shown, the housing 10 can be collinear to the well 3, in particular for a pushbutton forming a nasal spraying end-piece.

The housing 10 is provided with an anvil 11 around which a spray nozzle 12 is mounted so as to form a dispensing path for the pressurized product between said housing and a vortex chamber. To that end, the anvil 11 extends from the bottom of the housing 10 while leaving a communication channel 13 between the well 3 and said housing.

In the illustrated embodiment, the dispensing path successively has, in communication from upstream to downstream: an upstream annular conduit 18 in communication with the channel 13, said tubular conduit 18 being formed between the inner face of the side wall 14 of the nozzle 12 and the outer face of the side wall of the anvil 11 that is positioned opposite it; a downstream annular conduit 21 formed between the proximal wall 15 of the nozzle 12 and the distal wall 17 of the anvil 11. On the downstream side, the dispensing path supplies pressurized product to the vortex chamber 22, provided with at least one supply channel 24 of said chamber. More specifically, in the illustrated embodiment, the supply channels 24 communicate with the downstream annular conduit 21. In the illustrated embodiment, the nozzle has two supply channels 24 of the vortex chamber 22, said channels being arranged symmetrically relative to the dispensing axis D. Alternatively, more than two supply channels 24 can be provided, in particular three channels 24 arranged symmetrically relative to the dispensing axis D, or a single channel 24 can be provided to supply the vortex chamber 22.

The association of the nozzle 12 in the housing 10 is done by fitting the outer face of the side wall 14, the rear edge of said outer face further being provided with a radial projection 16 for anchoring the nozzle 12 in said housing. Furthermore, a cavity of the vortex chamber is formed hollowed in the proximal wall 15 and the end 11 has a planar distal wall 17 on which the proximal wall 15 of the nozzle 12 bears to define the vortex assembly between them. The nozzle 12 is further provided with a dispensing orifice 23 by which the product is sprayed.

Advantageously, the nozzle 12 and the body 1 are made by molding, in particular from a different thermoplastic material. Furthermore, the material forming the nozzle 12 has a rigidity exceeding the rigidity of the material forming the body 1. Thus, the significant stiffness of the nozzle 12 makes it possible to avoid deformation when it is mounted in the housing 10, so as to guarantee the geometry of the vortex chamber. Furthermore, the lower stiffness of the body 1 allows improved sealing between the mounting well 3 and the intake tube 4. In one example embodiment, the body 1 is made from polyolefin and the nozzle 12 is made from cyclic olefin copolymer (COC), polyoxyethylene or polybutylene terephthalate.

Figure 3:
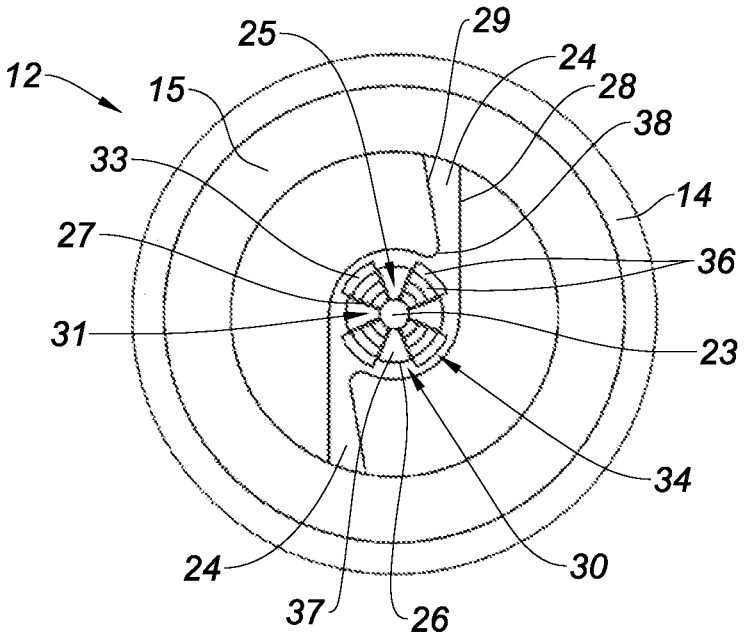
FIG. 3 schematically shows an enlarged sectional view of the inside of a nozzle of a dispensing system according to the embodiment of FIG. 1.
Figure 4:
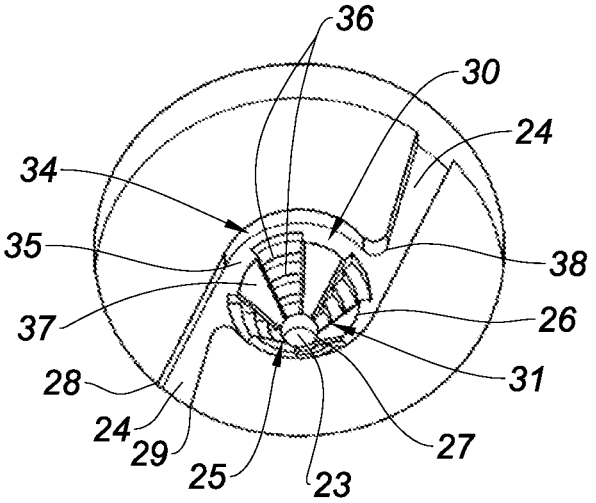
FIG. 4 schematically shows an enlarged perspective view of the vortex chamber of the nozzle of the embodiment of FIG. 1.
Figure 5:
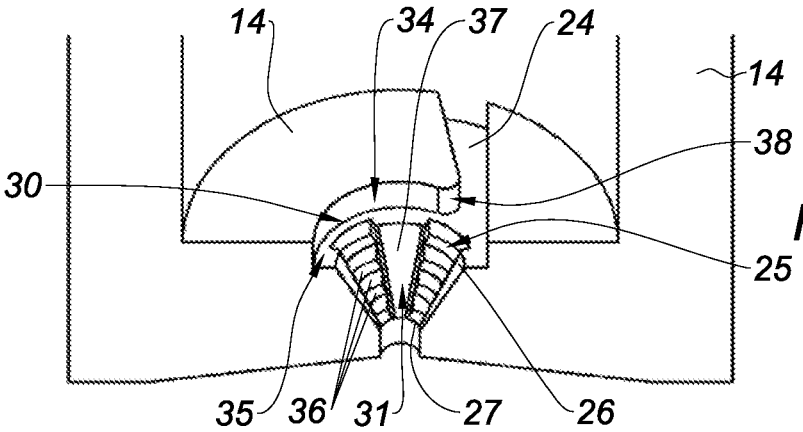
FIG. 5 schematically shows a cross-sectional view of the nozzle of the nozzle of the embodiment of FIG. 1.

In the embodiment shown in FIGS. 3 to 5, the vortex chamber 22 comprises a cylindrical part 30 in which the downstream end of the supply channels 24 emerges tangentially, the cylindrical part being defined by a side surface 34 that is cylindrical of revolution, which is closed toward the front by a proximal wall 35. The vortex chamber 22 additionally comprises a conical part 31 downstream from the cylindrical part 30. The conical part 31 is defined by a side surface 25 that extends along a dispensing axis D, the dispensing channels 24 extending in a transverse plane relative to said dispensing axis D. A conical part is defined as being a zone in which a first end or base of the conical part 31 has, in section along a plane orthogonal to this dispensing axis, a section whose surface area is larger than that of a second end or apex of the conical part 31. The first and second ends are connected by a generatrix that is not necessarily a straight line segment, but that may on the contrary be a curve having at least one plateau. Thus, the base and/or the apex of the conical part may have various shapes, in particular circular, polygonal, elliptical or the like. In the description, the spatial positioning terms are defined relative to the dispensing axis D. In the illustrated embodiment, the side surface 25 is of revolution around dispensing axis D. The side surface 25 converges from an upstream end 26 toward a downstream end 27 for supplying the dispensing orifice 23. Furthermore, the dispensing orifice 23 has an outlet dimension that is equal to the inner dimension of the downstream end 27.

Thus, during dispensing of the pressurized product, the tangential supply of the vortex chamber 22 makes it possible to rotate the product in the cylindrical part of said chamber; the product is next pressed and pushed in rotation through the upstream end 26 along the side surface 25 of said conical part while forming a pool of product, the rotational speed of which increases and which converges with the downstream end 27; then said converging pool can impact itself, escaping through the dispensing orifice 23 to form the aerosol.

According to the invention, the side surface has at least one stepped portion 33 provided with one level 36 or multiple levels 36. A level refers to a transverse surface, in particular orthogonal to the dispensing axis D of the chamber 22, situated between the base and the apex of the conical part. Thus, the stepped portions 33 have a stair-step shape, the levels 36 of which form the stairs. The stepped portions 33 here extend from the upstream end 26 to the downstream end 27 of the conical part, and have a width that decreases in proportion to the diameter of the conical part between the upstream and downstream ends. In the embodiment of FIGS. 3 to 5, the conical part 31 of the chamber 22 comprises four stepped portions 33 arranged periodically and symmetrically on the conical side surface 25, two stepped portions 33 being opposite one another. The stepped portions 33 are separated by continuous portions 37 of the side surface 25. Preferably, the continuous portions 37 overhang the levels 36 of the stepped portions 33 to form raised rims on either side of each stepped portion 33. Thus, the pools of product impact the rims while rotating in the chamber along the conical surface 25. Owing to these rims, the turbulence in the moving product is still further increased, to obtain finer droplets of product with uniform sizes. Additionally, the stepped portions 33 have a width that decreases in proportion to the diameter of the conical part 31 between the upstream end 26 and the downstream end 27.

Furthermore, to supply the vortex chamber 22 tangentially by rotating the product along its side surfaces 25, 34, each supply channel 24 has a U-shaped section that is defined between an outer wall 28 and an inner wall 29. The outer 28 and inner 29 walls are orthogonal to the upstream end 26. Furthermore, the outer wall 28 is tangent to the cylindrical side surface 34 and the inner wall 29 is offset from it, for example by a distance smaller than 30% of the inner dimension of the upstream end 26, so as to avoid impaction of the product in said upstream end. In the illustrated embodiment, the inner wall 29 advantageously has a convergence angle with the outer wall 28 in the upstream-downstream direction, the offset between said walls then being measured at the emergence section of the channels 24 in the upstream end 26. Preferably, the inner wall 29 has a convergence angle smaller than or equal to 10°. The inner wall is also connected to the cylindrical surface 34 of the chamber by a rounded corner 38, which preferably has a radius smaller than 0.1 mm.

Moreover, the downstream end of the supply channel 24 or the set of downstream ends of each of the supply channels 24 forms a supply section of the vortex chamber 22. To increase the dispensing time of a product dose over the actuating travel of the pushbutton, it is possible to provide that this supply section is small relative to the inner surface of the upstream end 26. In particular, the surface area of the supply section can be less than 10% of the inner surface of the upstream end 26. Preferably, the surface area of the supply section can be comprised between 0.01 $mm^2$ and 0.03 $mm^2$. In one example embodiment, the inner dimension of the upstream end 26 is 0.5 mm, i.e., an inner surface of 0.2 $mm^2$, and each channel 24 has a width of 0.12 mm and a depth of 0.13 mm, i.e., a surface area of 0.016 $mm^2$ for the supply section.

In the illustrated embodiment, the downstream end 27 of the vortex chamber is topped by a dispensing orifice 23 having a cylindrical geometry of revolution around the dispensing axis D, the inner dimension of said orifice being equal to the inner dimension of the downstream end 27. Advantageously, the axial dimension of the dispensing orifice 23 is small relative to its inner dimension, so as not to disrupt the convergence of the vortex pool. In particular, the axial dimension of the dispensing orifice 23 can be less than 50% of its inner dimension. In an alternative that is not shown, the downstream end 27 of the vortex chamber 22 can form a dispensing orifice 23. Aerosol production is particularly satisfactory when the inner dimension of the downstream end 27 is small relative to the inner dimension of the upstream end 26, such that the impaction of the pool is done as close as possible to the dispensing orifice 23. In particular, the inner dimension of the downstream end 27 can be less than 50% of the inner dimension of the upstream end 26, more specifically being comprised between 20% and 40% of said inner dimension.

Preferably, the axial dimension of the vortex chamber 22 is relatively large, in particular around or larger than the inner dimension of the upstream end 26, so as to allow the establishment of the vortex pool along the side surfaces 25, 34 of said vortex chamber 22 and to impart a gradual convergence. In particular, the axial dimension of the vortex chamber 22 is at least equal to 80% of the inner dimension of the upstream end 26, more specifically being comprised between 90% and 200% of said inner dimension.

According to one particular embodiment, the inner dimension of the cylindrical part is 0.6 mm, the upstream end 26 being 0.5 mm, and the inner dimension of the downstream end 27 is smaller than or equal to 0.14 mm. The axial dimension of the vortex chamber 22 is at least equal to 0.45 mm, knowing that the axial dimension of the conical part is 0.32 mm and the cylindrical part is 0.13 mm. The axial dimension of the dispensing orifice 23 is less than 0.10 mm, and the inner dimension is 0.14 mm.

Figure 6:
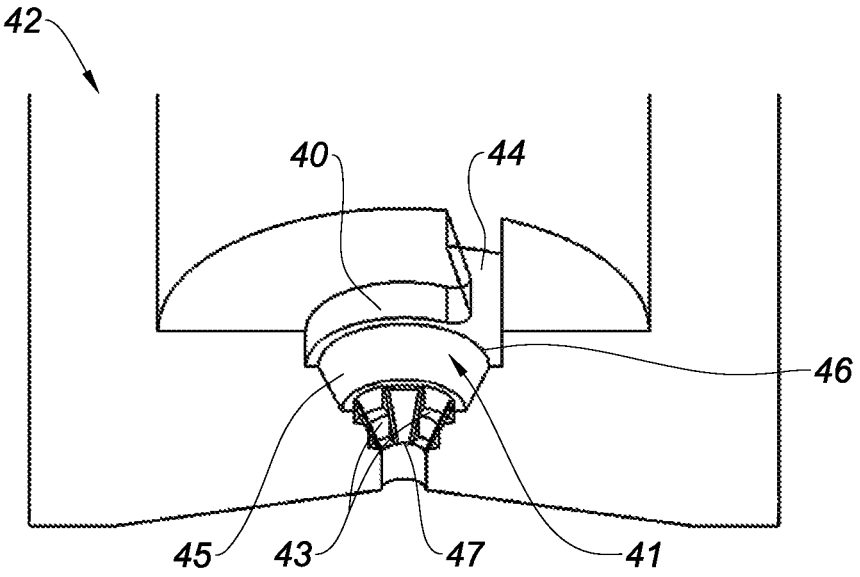
FIG. 6 schematically shows a cross-sectional view of a nozzle according to a second embodiment of the invention.

In FIG. 6, the second embodiment of the invention is a nozzle 42 similar to the nozzle of the first embodiment, except that the conical part 41 of the chamber 42 is only partially stepped. In this case, the conical side surface 45 comprises stepped portions 43 that extend over a smaller part of the side surface along the dispensing axis. Preferably, the stepped portions 43 are arranged toward the downstream portion 46. Here, the stepped portions 43 have dimensions that go substantially from the middle of the conical part 41 of the chamber 42 to its downstream end 47. Between the upstream end 46 and the middle of the conical part 41, the side surface 45 is continuous. The other features of this nozzle are the same as those of the nozzle of the first embodiment. The chamber 42 in particular comprises a cylindrical part 40 at the upstream end 46 of the conical part 41, and in which at least one supply channel 44 emerges.

According to different alternatives of the second embodiment, the stepped portion(s) may have variable dimensions, and for example be arranged on one third, one quarter, two thirds or three quarters of the side surface along the dispensing axis.

According to a third embodiment, an axis Y of the dispensing orifice 23 forms a predetermined angle A with the dispensing axis D. This angle is different from zero. This makes it possible to offset a pressure imbalance in the vortex chamber or to obtain spraying with a more or less bowed, or even flat, shape.

Figure 7:
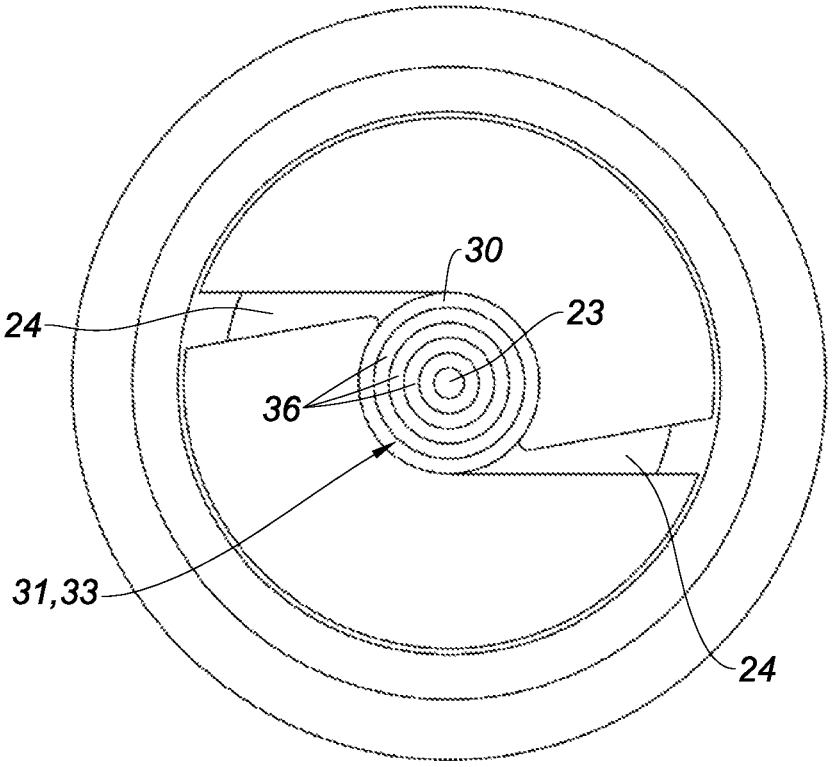
FIG. 7 is a cross-sectional view of the nozzle according to a fourth embodiment of the invention.
Figure 8:
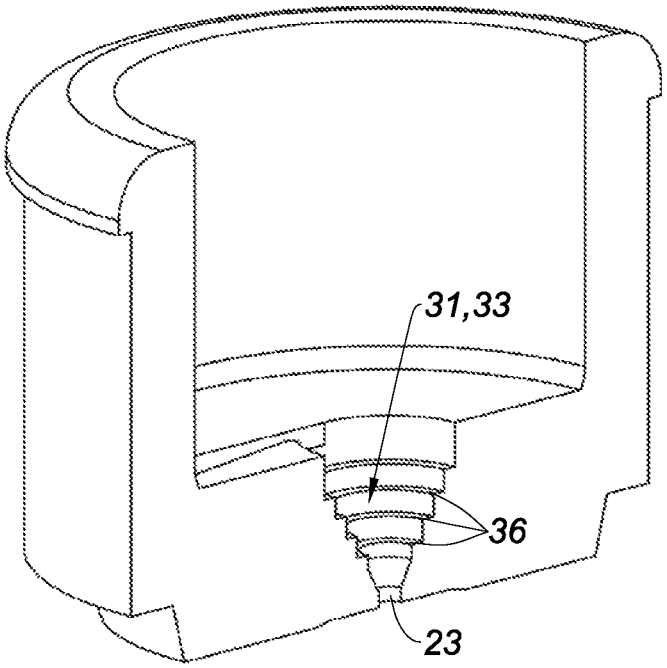
FIG. 8 is a perspective view of a nozzle, according to the fourth embodiment, cut along an axial plane; and, FIG. 9 is a perspective view of a nozzle, according to the fourth embodiment, part of which has been cut.
Figure 9:
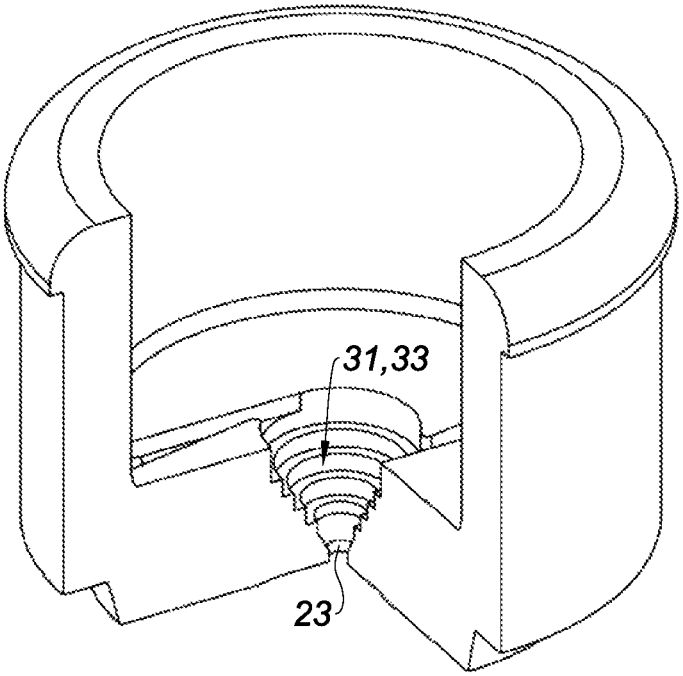

According to a fourth embodiment shown in FIGS. 7 to 9, the conical part 31 of the nozzle includes a stepped portion 33 that extends over the entire side surface 25. More specifically, the stepped portion 33 forms a complete revolution around the dispensing axis D.

The invention also relates to an assembly comprising a nozzle and an anvil. A front vortex chamber situated between the distal wall 17 of the anvil and the proximal wall 35 of the conical part, this vortex chamber having a cylindrical shape. Supply channels 24 emerge in said front vortex chamber, the latter emerging in the vortex chamber 22 of the nozzle.

These embodiments therefore make it possible to use a vortex chamber for a viscous product. The impaction of the vortex pool on the stepped portions in particular makes it possible to produce an aerosol made up of a uniform spatial distribution of droplets suspended in the air, the size of said droplets being small and uniform. In particular, the aerosol may then assume the appearance of a smoke plume with droplet sizes comprised between 10 μm and 60 μm, with an average of 35 μm, and irrespective of the bearing force that the user exerts on the pushbutton, in particular in the case of a needle pump.

Finally, the terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Having thus described the invention of the present application in detail and by reference to embodiments thereof, it will be apparent that modifications and variations are possible without departing from the scope of the invention defined in the appended claims as follows:

I claim:

1. A spray nozzle adapted for use with a system for dispensing a pressurized product provided with a pushbutton, the nozzle comprising:

a dispensing orifice and a vortex chamber emerging on the dispensing orifice, the chamber including a conical part defined by a conical side surface, said conical side surface converging from an upstream end toward a downstream supply end of the dispensing orifice, the nozzle further comprising at least one supply channel of said vortex chamber, the at least one supply channel emerging in the upstream end of the conical part, the conical side surface having at least one stepped portion provided with one or more levels, wherein the nozzle comprises at least one continuous portion developing along the conical side surface from the upstream end to the downstream supply end, and wherein said one continuous portion overhangs the at least one adjacent stepped portion in an inward radial direction along the entire length of the conical side surface.

2. The nozzle according to claim 1, wherein the at least one stepped portion extends substantially from the upstream end to the downstream end of the conical part.

3. The nozzle according to claim 1, wherein the at least one stepped portion is separated by a continuous portion.

4. The nozzle according to claim 1, wherein the conical side surface comprises several stepped portions arranged symmetrically on the conical side surface.

5. The nozzle according to claim 1, wherein the supply channels extend in a plane transverse to the conical side surface.

6. The nozzle according to claim 1, wherein the chamber comprises a cylindrical part arranged at the upstream end of the conical part, the cylindrical part being defined by a cylindrical side surface.

7. The nozzle according to claim 6, wherein the downstream supply end of the at least one supply channel emerges tangentially in the cylindrical part.

8. The nozzle according to claim 7, wherein the at least one supply channel includes an inner wall and an outer wall, the outer wall being tangent to the cylindrical side surface.

9. The nozzle according to claim 8, wherein the inner wall converges toward the outer wall going toward the downstream end of the channel.

10. The nozzle according to claim 1, wherein an axial dimension of the vortex chamber is at least equal to 80% of the inner dimension of the upstream end.

11. The nozzle according to claim 1, wherein an axial dimension of the conical part is at least 50% of the axial dimension of the vortex chamber.

12. The nozzle according to claim 1, wherein the conical side surface has a conical geometry of revolution around a dispensing axis D, and wherein an axis of the dispensing orifice forms a predetermined angle with the dispensing axis D.

13. A system for dispensing a pressurized product, comprising a spray nozzle adapted for use with a system for dispensing a pressurized product, a pushbutton, the nozzle being arranged on the pushbutton, wherein the spray nozzle comprises a dispensing orifice and a vortex chamber emerging on the dispensing orifice, the chamber including a conical part defined by a conical side surface, said conical side surface converging from an upstream end toward a downstream supply end of the dispensing orifice, the nozzle further comprising at least one supply channel of said vortex chamber, the at least one supply channel emerging in the upstream end of the conical part, the conical side surface having at least one stepped portion provided with one or more levels, wherein the nozzle comprises at least one continuous portion developing along the conical side surface from the upstream end to the downstream supply end, said one continuous portion overhangs the at least one adjacent stepped portion in an inward radial direction.

* * * * *